United States Patent [19]

Masuda et al.

[11] Patent Number: 4,505,649

[45] Date of Patent: Mar. 19, 1985

[54] VANE PUMPS

[75] Inventors: Kosaku Masuda, Kawagoe; Shuichirow Tashiro, Higashimatsuyama, both of Japan

[73] Assignee: Jidosha Kiki Co., Ltd., Tokyo, Japan

[21] Appl. No.: 418,566

[22] Filed: Sep. 15, 1982

[30] Foreign Application Priority Data

Sep. 25, 1981 [JP] Japan ..... 56-152433

[51] Int. Cl.[3] ..... F04C 2/00; F04C 15/00

[52] U.S. Cl. ..... 417/300; 418/149; 418/259

[58] Field of Search ..... 418/149, 259, 269, 178, 418/179; 417/310, 300

[56] References Cited

U.S. PATENT DOCUMENTS

| | | | |
|---|---|---|---|
| 2,816,702 | 12/1957 | Woodcock | 418/179 X |
| 3,190,183 | 6/1965 | Walker et al. | 418/178 X |
| 3,202,103 | 8/1965 | Sully | 418/178 X |
| 3,552,895 | 1/1971 | Bayley | 418/178 |
| 3,622,254 | 11/1971 | LeBlanc, Jr. | 418/178 |
| 4,080,122 | 3/1978 | Skrivanek et al. | 418/178 |
| 4,253,809 | 3/1981 | Ishizuka et al. | 418/178 X |
| 4,362,480 | 12/1982 | Suzuki et al. | 418/179 X |

*Primary Examiner*—John J. Vrablik
*Assistant Examiner*—T. Olds
*Attorney, Agent, or Firm*—Charles E. Pfund

[57] ABSTRACT

In a vane pump of the type comprising a rotor including radially slidable vanes, a cam ring accommodating the rotor, a front body and a rear body secured to both sides of the cam ring for defining pump chambers together with the cam ring, there is provided an intermediate body having an inner opening for accommodating the cam ring. The intermediate body is disposed between the front and rear bodies, and a portion of the inner opening is bulged outwardly to form a fluid passage for conveying operating fluid from the body to the rear.

3 Claims, 6 Drawing Figures

VANE PUMPS

BACKGROUND OF THE INVENTION

This invention relates to an improvement of a vane pump utilized for a power steering device for decreasing a handle steering power of a motor car, for example.

In the oldest type of the vane pump, a cam ring containing a rotor provided with vanes slidable in the radial direction is clamped between pump bodies. With this construction, however, the bodies undergo deformation as the pump discharge pressure increases to increase the clearance between the pump bodies and the cam ring thereby causing internal leakage and decrease in the pump efficiency.

To solve this problem, according to a vane pump of this type, a pair of plates are provided on both sides of the cam ring to form a set of pump cartridge which is incorporated into the pump bodies. Furthermore, a high pressure chamber subjected to the pump discharge pressure is provided on the outside of our plate so as to urge the plate against the cam ring by the fluid pressure to decrease the clearances between various members to values less than a definite value. Such pump is called a pressure loading type pump.

However, the vane pump of the pressure loading type requires the pair of plates described above, a spring for holding the plates and sealing member for sealing various members. Thus, this type require a large number of component parts and its construction is complicated so that the size and weight of the pump increase and the manufacturing cost is high.

These problems counteract energy saving which is strongly desired in recent years. More particularly, the vane pump of this type is susceptible to such limitations that it is installed in a narrow space of an engine room, and that it has an influence upon the cost and weight of a motor car. Accordingly, it has been desired to provide a vane pump having smaller size and weight and which can be manufactured at lower cost than the prior art vane pump. In recent years, power steering apparatus are used even in small motor cars so that the requirement described above becomes more universal.

Accordingly, in recent years the vane pump whose discharge pressure may be low is not constructed as the pressure loading type and a pair of plates on both sides of the cam ring are not used, but instead the cam ring is directly held between the pump bodies. One example of such a pump is disclosed in Japanese Laid Open Patent Specification No. 69491/1981. In the vane pump disclosed in this laid open patent specification, a cam ring having a substantially elliptical shape and adapted to contain a rotor has an external shape the same as that of the pump bodies connected to both sides of the cam ring, and a fluid passage for conveying pump suction side fluid from one body to the other is formed through the cam ring. Further, sealing grooves for receiving sealing members for preventing leakage of the operating fluid are formed on both side surfaces. Accordingly, the shape of the vane pump is complicated and difficult to machine. Especially, when the cam ring is made of a high grade alloy casting its cost and weight are large. Where sintered material is used the fluid in the pump has a tendency to leak.

SUMMARY OF THE INVENTION

Accordingly, it is an object of this invention to provide an improved vane pump which can be readily machined, has a small size, light weight and high efficiency.

According to this invention, there is provided a vane pump of the type comprising a rotor including radially slidable vanes, a cam ring accommodating the rotor, a front body and a rear body which are secured to both sides of the cam ring for defining pump chambers together with the cam ring, characterized in that an intermediate body having an inner opening for accommodating the cam ring is disposed between the front body and the rear body and that a portion of the inner opening is bulged outwardly to form a fluid passage for conveying operating fluid from the front body to the rear body.

BRIEF DESCRIPTION OF THE DRAWING

These and further objects and advantages of the invention can be more fully understood from the following detailed description taken in conjunction with the accompanying drawings in which.

DESCRIPTION OF THE PREFERRED EMBODIMENT

Figure 1:
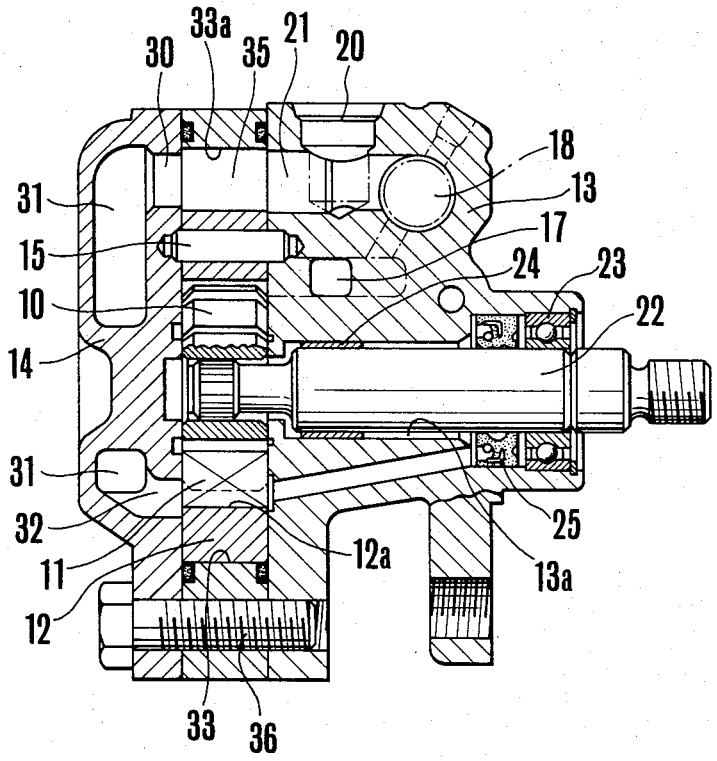
FIG. 1 is a longitudinal sectional view showing one embodiment of the vane pump of this invention.
Figure 2:
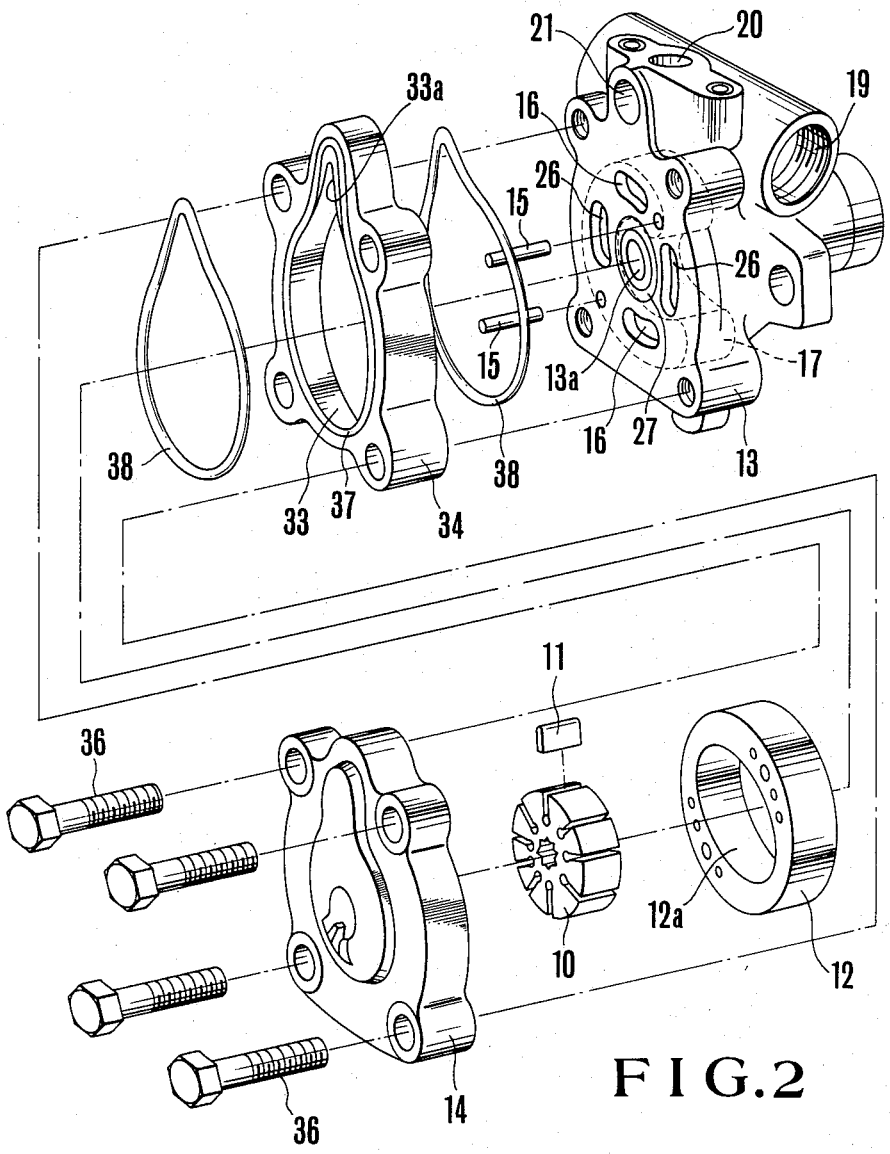
FIG. 2 is an exploded perspective view of the essential elements of the vane pump shown in FIG. 1.

The vane pump shown in the accompanying drawing comprises a cylindrical rotor 10 provided with a plurality of vanes 11 slidably received in radial slots, and a cam ring 12 surrounding the rotor 10 and having a substantially elliptical inner cam surface 12*a*. The cam ring 12 has a circular outer surface and preferably is made of sintered material.

On both sides of the cam ring 12 containing the rotor 10 are directly urged a front body 13 and a rear body 14 constituting a pump body so as to form a pair of pump chambers about the rotor 10 together with the cam ring 12. When compared with the prior art pressure loading type vane pump, this construction can eliminate a pair of plates, thus decreasing the number of the component parts and the size of the pump. Pins 15 are used to determine rotational positions of the cam ring 12 and the front and rear bodies 13 and 14.

Figure 3:
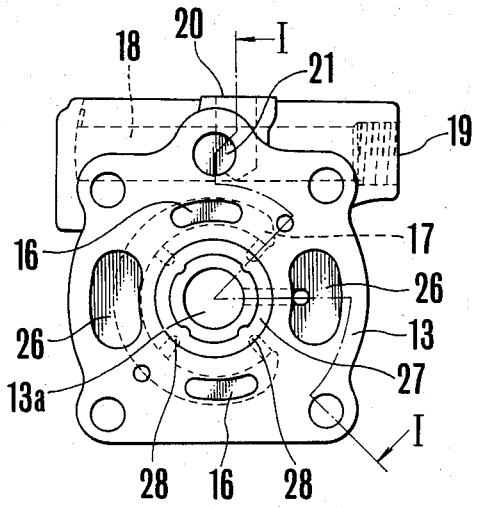
FIG. 3 is a lefthand side view of the front body.

The inner surface of the front body 13 has a larger diameter than the cam ring 12, and as shown in FIG. 3, a high pressure chamber 17 is formed in the front body to which fluid discharged from the pump is conveyed through discharge ports 16 formed corresponding to respective pump chambers. The high pressure chamber 17 is communicated with a discharge port 19 opened to one side via a valve opening 18 formed on the upper portion of the front body 13. The valve opening 18 is communicated with a passage 21 opening at the upper side of the inner surface of the front body 13, while a suction port 20 provided at the upper portion of the body is connected with a passage 21.

As shown in FIG. 1, the rotor 10 has a shaft 22 extending through a shaft hole 13*a* formed through the front body 13. The shaft 22 is journaled by a ball bearing 23 and a needle bearing 24 and the inner end of the shaft 22 is coupled to the rotor 10 by splines. A pulley, not shown, driven by the engine of a motor car through a V belt is mounted on the outer end of the shaft 22. An oil seal 25 is provided for the ball bearing 23. Grooves 26 are formed on the inner surface of the front body 13 to confront a suction port of the rear body 14 to be described later. An annular groove 27 is provided to convey pressurized oil in the high pressure chamber 17 to the roots of the vanes through an opening 28.

Figure 4:
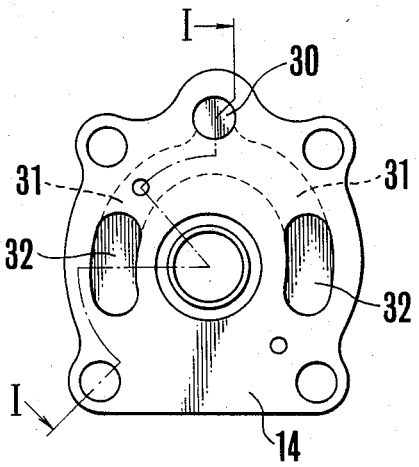
FIG. 4 is a righthand side view of the rear body.

The diameter of the rear body 14 confronting the front body 13 is also made to be larger than that of the cam ring 12, and as shown in FIG. 4, a passage 30 communicated with the suction side is provided at the upper side to oppose the passage 21 of the front body 13. The passage 30 is divided into two branch passages 31 in the rear body 14, the other ends of the branch passages being connected with suction ports 32 opened in the pump chamber.

Figure 5:
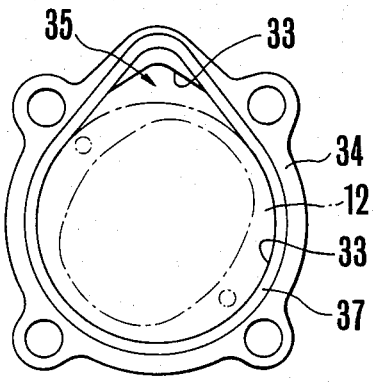
FIG. 5 and FIG. 6 are righthand and lefthand side views respectively of the intermediate body.
Figure 6:
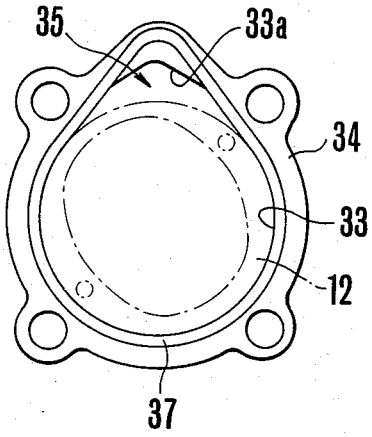

According to this invention, between the front and rear bodies 13 and 14 clamping the cam ring 12 therebetween is disposed an intermediate body 34 having a circular opening 33 for accommodating the cam ring 12. The upper portion of the intermediate body 34 is bulged outwardly as at 33*a* for forming a fluid passage 35 for interconnecting passages 21 and 30 on the suction side provided for the front and rear bodies 13 and 14. More particularly, as shown in FIGS. 5 and 6, the intermediate body 34 has an outer contour corresponding to those of the front and rear bodies 13 and 14 and is formed of an aluminum die casting which is light and has an excellent castability.

The intermediate body 34, and the front and rear bodies 13,14 clamping the cam ring 12 therebetween are assembled together by four bolts 36 to form a pump body. On both sides of the intermediate body 34 are formed substantially annular grooves 37 to surround the center opening 33 and the bulged portion 33*a*. O rings 38 are fitted in the grooves 37 to seal the joints between the intermediate body and the front and rear bodies.

The pump can be readily assembled by inserting the cam ring 12 incorporated with the rotor 10 into the inner opening 33 and then securing both bodies 13 and 14 to the intermediate body to both sides thereof through O rings 38.

In this manner, the passage 21 on the suction side in the front body 13 is connected to the passage 30 in the rear body 14 via the passage 35 formed between the periphery of the cam ring 12 and the bulged portion 33*a* of the intermediate body 34.

With the construction described above, as the rotor 10 is rotated to begin the pumping action the operating fluid flowing into the suction port 20 of the front body 13 is sent to the rear body 14 through passages 21 and 35, sucked into respective pump chambers through passages 30 and 31 and suction ports 32 and then sent to the high pressure chamber 17 through the discharge ports 16 of the front body 13. The quantity of the operating fluid sent from the high pressure chamber 17 to the valve opening 18 is controlled by a flow control valve, not shown, incorporated into the valve opening 18. The flow control valve is of the well-known type as illustrated in U.S. Pat. No. 3,645,647. The operating fluid is then discharged from the discharge port 19 and surplus quantity is returned to the passage 21 which is mixed with the operating fluid from the suction port 20 and again sent to the passages 35, 30 and 31 to be circulated in the pump and discharged.

The passages 21, 35 and 30 communicated with the suction ports 32 of the pump through the valve opening 18 and the suction port 20 also act as a circulating passage. Further this construction greatly improves the suction performance by a so-called spray effect at the time of the high speed operation of the pump, thus increasing the efficiency of the pump.

According to this invention the passage 35 on the suction side for interconnecting the front body 13 and the rear body 14 is defined by the bulged portion 33*a* of the light weight intermediate body 34 and the periphery of the cam ring 12 contained therein so that it is possible to obtain a high pressure vane pump of an inexpensive and small size.

As above described, according to this invention, a cam ring 12 directly clamped between the front and rear bodies 13,14 is contained in an inner opening of an intermediate body 34, and a fluid passage for conveying the operating fluid from the front body to the rear body is defined by a bulged portion 33*a* formed at a portion of the inner opening and the periphery of the cam ring 12 so that there are the following merits. 1. When compared with a case wherein the cam ring is also used as the pump body and a pump suction passage is provided for the cam ring, the various component elements, especially the cam ring and the intermediate body can be readily machined or cast. Furthermore, as it is possible to simultaneously form grooves for receiving sealing members at the time of forming the intermediate body, the manufacturing cost of the pump can be decreased. 2. Since the intermediate body can be prepared by die casting, the weight and cost of the pump can be decreased. 3. Since the cam ring is contained in the intermediate body, the leakage of the operating fluid from the periphery of the cam ring can be prevented by the intermediate body and the O rings so that the cam ring can be made of sintered material to decrease the manufacturing cost and weight. Moreover, the configuration of the cam ring can be standardized irrespective of the outer contour of the pump. 4. Since the passage on the suction side is defined by the bulged portion of the intermediate body and the periphery of the cam ring, the suction performance of the pump at the high speed operation can be improved with simple construction.

Although in the foregoing description a specific preferred embodiment of this invention was described in detail, it should be understood that various changes and modifications may be made without departing from the scope of the invention as defined in the accompanying claims.

What is claimed is:

1. An axial flow vane pump comprising:

a rotor including radially slidable vanes;

a cam ring having an eccentric opening accommodating said rotor to form pump chambers;

a front body and a rear body secured to both sides of said cam ring for defining said pump chambers together with said cam ring; and an intermediate body disposed between said front body and said rear body and having an inner opening for accommodating said cam ring;

a portion of said inner opening of said intermediate body being bulged outwardly to form together with an outer periphery of said cam ring a fluid passage for conveying operating fluid axially from said front body to said rear body;

said front body having inlet and outlet ports with said inlet port communicating with a passage aligned with said fluid passage;

said rear body having an axial passage aligned with said fluid passage and an arcuate passage for conveying working fluid from said axial passage to an axial suction port open to communicate with said pump chambers;

said front body having an axial port in communication between the high pressure outlet of said pump chambers and a high pressure chamber in said front body which delivers working fluid to a valve opening therein for passage to a discharge port and recirculates excess fluid to mix with operating fluid at said inlet port.

2. The vane pump according to claim 1 wherein grooves are formed on both sides of said intermediate body for receiving sealing members.

3. The vane pump according to claim 1 wherein said intermediate body is formed by aluminum dicasting.

* * * * *